United States Patent [19]

Jilla

[11] 3,932,126

[45] Jan. 13, 1976

[54] DYEING ASSISTANT COMPOSITION CONTAINING ORGANIC AMINES AND CARBOXYLIC ACIDS FOR COLORING POLYESTER MATERIAL WITH ACID DYES

[75] Inventor: Dara Ardeshir Jilla, Collinsville, Va.

[73] Assignee: Martin Processing Co., Inc., Martinsville, Va.

[22] Filed: Oct. 5, 1973

[21] Appl. No.: 403,850

[52] U.S. Cl. ..... 8/172; 8/85; 8/92; 8/173

[51] Int. Cl.[2] ..... D06P 1/645; D06P 1/653

[58] Field of Search ..... 8/172, 173, 85, 92, 176

[56] References Cited

UNITED STATES PATENTS

| | | | |
|---|---|---|---|
| 2,092,429 | 2/1936 | Straub et al. | 8/42 R X |
| 3,164,436 | 1/1965 | Altermatt | 8/172 X |
| 3,480,378 | 11/1969 | Taube et al. | 8/172 |

FOREIGN PATENTS OR APPLICATIONS

| | | | |
|---|---|---|---|
| 587,771 | 11/1959 | Canada | 8/172 |

*Primary Examiner*—Benjamin R. Padgett
*Assistant Examiner*—David Leland
*Attorney, Agent, or Firm*—Stevens, Davis, Miller & Mosher

[57] ABSTRACT

A process is disclosed for coloring a polyester material, which comprises impregnating the same by padding, printing or cascading with an aqueous solution or printing paste of one or more acid dyes incorporated with both (a) an organic nitrogen compound and (b) an organic carboxylic acid, drying the impregnated polyester material and then exposing same to dry heat at a temperature between 150°C. and 230°C. for a period of 5 to 60 seconds, thereby effecting fixation of said acid dye or dyes on the polyester material and uniform distribution thereof within the polyester material. The organic nitrogen compound with which the polyester material is treated is an alkyleneamine, an alkanolamine, or an alkylamine. Suitable lengths (in the direction of travel) of the polyester yarn or other form of polyester material undergoing the said impregnation is contacted in a precise, controlled manner according to a predetermined pattern to produce any desired variegated pattern contour in the final dyed polyester material. The process is preferably carried out continuously. The acid-dyed polyester material in various forms is also a part of the invention.

10 Claims, No Drawings

DYEING ASSISTANT COMPOSITION CONTAINING ORGANIC AMINES AND CARBOXYLIC ACIDS FOR COLORING POLYESTER MATERIAL WITH ACID DYES

In my copending application Ser. No. 396,805, filed Sept. 13, 1973, I describe and claim the coloring of polyester materials with acid dyes which comprises imgregnating the same, preferably continuously, at a temperature between 90°C. and 250°C. and at ordinary atmospheric pressure with a mixture of (a) an organic nitrogen compound and (b) a glycol, an alcohol, a ketone, an ether, or water; then flash-cooling the thus-treated material with cold water or mixture of a carboxylic acid with cold water and thereby imparting affinity for acid dyes to the treated polyester material, and then coloring the same, preferably continuously, by methods of padding, printing or cascading acid dyes from an aqueous solution or a printing paste whereby to effect fixation of said acid dyes on the treated material with substantially uniform distribution thereof within the material.

The present invention is in the nature of a still further improvement over the general procedure just described, and concerns itself primarily with still another novel process for coloring polyester materials, preferably but not necessarily continuously, with acid type dyes.

Polyester materials are mainly dyed with disperse and azoic dye combinations and certain vat dyes, as more fully described on pages 21–267 of The Dyeing of Polyester Fibers, Imperial Chemical Industries Limited, Third Edition, November 1964, published by Raithby, Lawrence and Company, Great Britain. Also, modified polyesters are dyeable with basic type dyes, as more fully described and claimed in the Griffing et al. U.S. Pat. No. 3,018,272. However, mere staining of polyester materials is obtained with other well known classes of dyes, such as direct, reactive, acid, chrome and sulphur dyes. These stains are almost always restricted to surface coloration, and possess poor fastness properties.

Accordingly, it is an object of this invention to provide a process for coloring shaped or preformed polyester materials with acid type dyes under novel conditions whereby to produce strong, very bright, uniform dyeings, well penetrated into the substrate. It is a further object of this invention to provide a novel process as aforesaid which is especially well adapted for continuous dyeing; that is, the dyeing of the polyester materials with acid dyes on a continuous roll by such per se known methods as padding, printing or cascading. Yet another object is to provide a shaped or preformed article produced from polyester material dyed in the manner described hereinafter. Additional important objects of this invention will appear more fully as the description proceeds.

My novel process consists essentially in impregnating the polyester material by padding, printing or cascading with an aqueous solution or printing paste of one or more acid dyes incorporated with various organic nitrogen compounds and organic carboxylic acids, drying the impregnated polyester material, and then giving it a final dry heat treatment at a temperature of between 150°C. and 230°C. (or in some cases as high as 250°C.) for a brief interval of time, usually less than 1 minute, and more often of the order of 20 to 60 seconds or even merely 5 seconds.

Surprisingly, I find that this heat-treatment in conjunction with the presence of organic nitrogen compounds and organic carboxylic acids in the dyebath in some manner (which I am not able fully to explain) causes the acid dye particles deposited on the surface of the polyester material to penetrate the same, and to distribute the acid dye particles evenly over or throughout the entire cross section of the polyester material. The result is commercially important, inasmuch as very bright, strong and uniform coloration of the polyester material is obtained.

Alternatively, suitable portions of the shaped polyester material (such as yarn) may be impregnated with the above-mentioned dyebath in the direction of yarn travel whereas other portions of the yarn in the direction of yarn travel are not impregnated with the above-mentioned dyebath, drying the impregnated polyester material, and then giving it the above-mentioned dry heat treatment. This selective impregnation of the polyester material with the above-mentioned dyebath may be varied in a precise controlled manner according to any predetermined pattern by means per se well known in the art. Very strong and bright and uniform coloration is produced in those localized regions of the yarn which were impregnated with the above-mentioned dyebath whereas no coloration is produced in those localized regions of the yarn which were not impregnated with the above-mentioned dyebath. The result is selective coloration of the polyester material in a predetermined manner to produce a pleasing pattern in the final yarn. Any desired pattern contour may be produced in this way, whether random or repetitive.

The initial drying of the impregnated polyester material, which for convenience may be called a predrying, may be carried out in any convenient equipment per se well known in the art, such as a dielectric heater, a microwave heater, an infrared radiant heater, operating at temperatures of the order of about 450° to 550°F. and for a time (e.g., up to about 60 seconds) sufficient to effect substantially complete removal of the moisture from the impregnated polyester material preparatory to the subsequent dry heat color fixation step.

Examples of preferred organic nitrogen compounds include alkyleneamines, alkanolamines and alkylamines, such as diethylenetriamine, triethylenetetramine, tetraethylenepentamine, hexamethylenediamine, hexamethylenetetramine, mono-, di- and tri-ethanolamine, triethylamine, di and tripropylamine, and di- and tributylamine.

Suitable organic carboxylic acids are for example oxalic acid, sebacic acid, citric acid and adipic acid.

Other methods of applying the principles of this invention may be employed instead of those specifically mentioned inasmuch as it will be apparent that obvious modification thereof may be made within the skill of the art without departing from the spirit of the invention and the scope of the appended claims. Without limiting my invention, therefore, the following examples are given in order still better to illustrate the details of operation. Unless otherwise indicated, parts mentioned are by volume.

These examples include actual runs made in the laboratory to test the chemical validity of the process. Because of the laboratory scale of the test, the experiments were done on a relatively limited quantity of polyester yarn and fabric using a batch process. The convertibility of the process in each instance into continuous operation on a plant scale (using conventional apparatus appropriate for plant scale operation) is perfectly obvious from the short period of time required for both the predying of the polyester material and the subsequent color fixation.

EXAMPLE 1

A printing paste containing the following ingredients was prepared:

| | | |
|---|---|---|
| Merpacyl Blue SW (C.I. 25) | 1 | gram |
| Triethylenetetramine (commercial, b.p. 276°C. | 20 | cc. |
| Water | 200 | cc. |
| Oxalic acid (the commercial dihydrate, m.p.101°C.) | 0.5 | gram |
| Sulphuric acid concentrated) | 0.2 | cc. |
| Polygum 560 (a commercial thickener or printing gum) | 0.6 | gram |

A strip of polyethylene terephthalate fabric was printed with this paste at 67°C. and dried. It was then slowly passed through a flue drier maintained at 204°C., the rate of feed being regulated to give an exposure time of 60 seconds. The fabric was then rinsed to remove any residual, loosely adhering, superficial dye particles and dried. A deep, strong, bright blue shade was obtained.

In contrast, a control sample of polyethylene terephthalate fabric printed with a similar printing paste of this same color, but without the triethylenetetramine and oxalic acid, produced essentially no coloration even after prolonged heating.

In a similar manner, uniform, bright and strong dyeings of shades as indicated were obtained on polyethylene terephthalate fabric with the following dyes when applied as described above:

| Dye Employed | Shade Obtained |
|---|---|
| Merpacyl Blue 2GA, C.I. Acid Blue 40 | Blue |
| Anthralan Violet 3B, C.I. Acid Violet 43 | Violet |
| Du Pont Anthraquinone Green GNN, C.I. Acid Green 25 | Green |
| Telon Fast Violet EF, C.I. Acid Violet 103 | Bright Violet |

EXAMPLE 2

A printing paste containing the following ingredients was prepared:

| | | |
|---|---|---|
| Merpacyl Blue 2GA (C.I. 40) | 1 | gram |
| Du Pont Anthraquinone Green GNN (C.I. 25) | 1 | gram |
| Tetraethylenepentamine (commercial, b.p. 340°C.) | 20 | cc. |
| Adipic acid (commercial, m.w. 146.14, m.p. 152°C.) | 0.5 | gram |
| Sulphuric acid (concentrated) | 0.2 | cc. |
| Polygum 560 (a commercial thickener or printing gum) | 0.6 | gram |
| Water | 200 | cc. |

Selected portions of polyethylene terephthalate staple fiber yarn about 10 inches long in the direction of yarn travel were printed with this paste at 67°C. and dried, whereas adjacent portions of the same yarn about 10 inches long were left unprinted. The yarn was then slowly passed through a gas drier maintained at 200°C., the rate of feed being regulated to give an exposure time of 60 seconds. The yarn was then rinsed and dried. A deep, greenish-blue shade was obtained in those localized regions of the yarn which had been printed with the above-mentioned printing paste. In contrast, no coloration was produced in those localized regions of the yarn which had not printed with the above-mentioned printing paste.

In this manner, a definite pattern was obtained in the final yarn, with greenish-blue colored localized regions along the direction of yarn travel followed by adjacent localized regions with no coloration, and this is repetitive. An extremely beautiful variegated effect was obtained in this manner.

EXAMPLE 3 — MIXED DYES

A paste containing the following ingredients was prepared:

| | | |
|---|---|---|
| (A) | | |
| Palanil Yellow 3G (C.I. 64) | 1 | gram |
| Nylomine Acid Blue C-2G (C.I. 175) | 0.2 | gram |
| Diethylenetriamine (commercial, b.p. 206.7°C.) | 20 | cc. |
| Adipic acid (commercial, m.w. 146.14, m.p. 152°C.) | 0.5 | gram |
| Sulphuric acid (concentrated) | 0.2 | cc. |
| Polygum 560 (a commercial thickener or printing gum) | 0.6 | gram |
| Water | 200 | cc. |

Similarly, a paste containing the following ingredients was prepared:

| | | |
|---|---|---|
| (B) | | |
| Celliton Pink RF (C.I. 4) | 1 | gram |
| Polygum 560 (a commercial thickener or printing gum) | 0.6 | gram |
| Water | 200 | cc. |

Selected portions of polyethylene terephthalate staple fiber yarn about 10 inches long in the direction of yarn travel were printed with paste (A) whereas adjacent portions of the same yarn about 10 inches long were printed with paste (B) and the whole dried. The thus-treated yarn was then passed continuously between two metal surfaces maintained at 210°C. in such a way that the exposure time was 45 seconds. The yarn was then rinsed and dried. An extremely beautiful variegated effect was obtained showing different colors, some blue, some yellow, some green, some red, some orange, some brown, and some involving various blends of colors.

It will be clear from the above examples that my invention is applicable with a wide variety of polyester materials. Multi-filament, continuous filament or staple fiber yarns and fabrics are the preferred structures of the present invention. These polyester materials treated according to my invention produce commercially important, very bright, strong (and, if desired, variegated) coloration suitable for the usual textile applications. A complete range of hues can be obtained, many of them being very bright.

These polyester materials may be employed in the knitting, weaving or tufting of fabrics of all types as well as in the production of carpets and non-woven felt-like products produced by known methods.

By an "acid dye" is meant a colored anionic organic substance such as those containing azo, anthraquinone, quinoline, triphenylmethane, azine, xanthene, ketonimine, nitro or nitroso compounds. Among the acid dyes which may be applied to the polyester materials in accordance with the present invention may be mentioned Merpacyl Blue SW (C.I. 25); Merpacyl Blue 2GA (C.I. 40); Nylomine Acid Blue C-2G (C.I. 175); Telon Fast Violet EF (C.I. 103); Du Pont Anthraquinone Green GNN (C.I. 25); Chinoline Yellow O (C.I. 3); Levalan Red 3B (C.I. 80); and the like. Not all of these acid dyestuffs are applicable with equal advantage to all classes of polyester material. Thus, anthraquinone type acid dyes are of special interest in connection with polyethylene terephthalate fiber. But in all cases, heat-treatment in conjunction with the presence of organic nitrogen compounds and organic carboxylic acids in the dyebath according to my invention surprisingly produces commercially important, very bright, strong, variegated coloration, even though the nature of the gain may depend on the particular combination of polyester material and acid dye under consideration. The acid dyes are preferably applied from an aqueous solution at a temperature between about 50°C. and 125°C.

If desired, the aqueous dye solutions may be rendered strongly acidic in conventional manner such as by the addition of an appropriate amount of an acid such as sulphuric acid. Other dyebath additives, such as thickeners, foaming agents, wetting agents, levelling agents, retarders or buffers may also be present.

When reference is made in the subjoined claims to an acid dye, it will be understood that mixtures of different acid dyes are contemplated as being within the invention.

To summarize, the practice of my invention achieves a broadening of the base of applicable colors in the case of polyester materials, resulting in commercially important, very bright, strong, variegated (if desired) coloration when dyed with acid dyes in the manner indicated.

I do not wish to be limited to the treatment of any particular kind of polyester material, especially since polyester materials are old and well known and per se form no part of the present invention. Consequently, I consider it sufficient for background disclosure purposes to refer broadly to the following literature source for further information on these per se old materials: Mark-Gaylord's Encyclopedia of Polymer Technology, Vol. 11, 1969, pages 1–128. The polyethylene terephthalate specially mentioned above by way of example is of course a well-known kind of commercially available polyester material.

What is claimed is:

1. A process for coloring a polyester material, which comprises impregnating the same by padding, printing or cascading with an aqueous solution or printing paste of one or more acid dyes in admixture with both (a) a separate organic nitrogen compound selected from the class consisting of diethylenetriamine, triethylenetetramine, tetraethylenepentamine, hexamethylenediamine, hexamethylenetetramine, and mono-, di- and tri-ethanolamines, and (b) a separate organic carboxylic acid, drying the impregnated polyester material and then exposing same to dry heat at a temperature between 150°C. and 250°C. for a period of 5 to 60 seconds, thereby effecting fixation of said acid dye or dyes on the polyester material and substantially uniform distribution thereof within the polyester material.

2. A process as defined in claim 1, wherein the impregnating and drying and dry-heating steps are carried out continuously.

3. A process as defined in claim 1, wherein predetermined portions of the polyester material undergoing the said impregnation are contacted in a precise, controlled manner according to a predetermined pattern to produce any desired variegated pattern contour in the final dyed polyester material.

4. A process as defined in claim 3, wherein the impregnating and drying and dry-heating steps are carried out continuously.

5. A process as defined in claim 3, wherein the impregnation of the polyester material is random but controlled in a precise manner to obtain variegated effect in the final dyed polyester material.

6. A process as defined in claim 5, wherein the impregnating and drying and dry-heating steps are carried out continuously.

7. An acid-dyed polyester material that has been first impregnated with an aqueous solution or printing paste of one or more acid dyes in admixture with (a) a separate organic nitrogen compound selected from the class consisting of diethylenetriamine, triethylenetetramine, tetraethylenepentamine, hexamethylenediamine, hexamethylenetetramine, and mono-, di- and tri-ethanolamines, and (b) a separate organic carboxylic acid, dried, and then exposed to a dry heat-treatment to fix the acid dye or dyes in the polyester material.

8. The acid-dyed polyester material of claim 7, wherein the polyester material is in the form of a fiber or filament.

9. The acid-dyed polyester material of claim 7, wherein the polyester material is in the form of a multifilament continuous filament or staple fiber yarn.

10. The acid-dyed polyester material of claim 7, wherein the polyester material is in the form of a woven, nonwoven, knitted, tufted, needle-punched, flocked or laminated fabric.

* * * * *